US005177902A

United States Patent [19]

Baba et al.

[11] Patent Number: 5,177,902

[45] Date of Patent: Jan. 12, 1993

[54] ULTRASONIC GRINDER SYSTEM FOR CERAMIC FILTER AND TRIMMING METHOD THEREFOR

[75] Inventors: Takahisa Baba; Fujio Horiguchi; Kiyoshi Miyaki, all of Tokyo, Japan

[73] Assignee: Oki Electric Industry Co., Ltd., Tokyo, Japan

[21] Appl. No.: 735,648

[22] Filed: Jul. 25, 1991

[30] Foreign Application Priority Data

Aug. 8, 1990 [JP] Japan ..... 2-208270
Aug. 8, 1990 [JP] Japan ..... 2-208271

[51] Int. Cl.[5] ..... B24B 7/22

[52] U.S. Cl. ..... 51/59 SS; 51/166 TS; 83/13; 83/701

[58] Field of Search ..... 51/59 SS, 166 TS, 166 MH, 51/240 R, 240 T, 240 A; 83/13, 701

[56] References Cited

U.S. PATENT DOCUMENTS 3,754,448 8/1973 McDaniel ..... 51/59 SS
3,897,659 8/1975 Henry ..... 51/165.71
4,431,977 2/1984 Sokola et al. ..... 333/206
4,716,391 12/1987 Moutrie et al. .
4,742,562 5/1988 Kommrusch ..... 333/206
4,855,693 8/1989 Matsukura et al. ..... 333/202
4,934,103 6/1990 Campegue et al. .

FOREIGN PATENT DOCUMENTS 62-74561 4/1987 Japan .

OTHER PUBLICATIONS

D. Kremer et al., *Verre*, vol. 2, Jan.-Feb. 1988, pp. 27-36.

R. Davies et al., *Microwave Hybrid Integrated Circuit* Technology, vol. 84, No. 1506, 1978, pp. 46-50 and 67.

*Primary Examiner*—Bruce M. Kisliuk
*Assistant Examiner*—Eileen P. Morgan
*Attorney, Agent, or Firm*—Spencer, Frank & Schneider

[57] ABSTRACT

An ultrasonic grinder system for a ceramic filter is disclosed. A metallic layer on the ceramic filter is trimmed by a cutting blade which is vibrated at an ultrasonic frequency. Further, the vibration is fed back to a microcomputer via a sensor and the microcomputer controls movement of an XYZ stage on which both of the cutting blade and ceramic filter are mounted. The CPU detects a standard level of the trimming procedure by the sensor and controls the XYZ stage to obtain a predetermined depth and area of the trimmed portion on the ceramic filter.

19 Claims, 6 Drawing Sheets

ULTRASONIC GRINDER SYSTEM FOR CERAMIC FILTER AND TRIMMING METHOD THEREFOR

REFERENCE TO RELATED APPLICATIONS

This application claims the right of priority under 35 U.S.C. 119 of Japanese applications Ser. No. 2082070/90, filed on Aug. 8, 1990, and No. 208271/90, also filed on Aug. 8, 1990 the entire disclosure of which is incorporated herein by reference.

BACKGROUND OF THE INVENTION

1. Field of the Invention

This invention relates to an ultrasonic grinder system for tuning the frequency of a ceramic filter and which is suitable for automating the tuning step. Further, the present invention relates to a method for effective trimming to obtain a finely tuned ceramic filter using the ultrasonic grinder system.

2. Brief description of the related art

Recently, in the mobile communication technology, a 800 MHz band single body ceramic filter has been commonly featured in small telephone products. For example, U.S. Pat. Nos. 4,431,977 and 4,742,562 disclose such ceramic filters made by a single ceramic block. Those ceramic filters are tuned by trimming a predetermined portion of a metallic layer metalized on the ceramic block.

In the tuning step, it is required to accurately remove the metallic layer in a predetermined pattern.

An example of such a trimming method is disclosed in U.S. Pat. No. 4,855,693 filed by the applicant. Further, trimming methods which feature different physical principles employ correspondly different types of trimming apparatus. For example, a laser trimming method features a high-power laser beam to evaporate the metallic layer on the ceramic and a sand blast method features a nozzle which blows sands of carbon silicate to cut the metallic layer. One of the most conventional trimming method features a micro rotary grinder, using a diamond point which directly cuts the metallic layer.

However, the above known trimming methods have respective disadvantages. For example, the laser trimming method needs a high electric power source to obtain high power energy of the laser beam and it is difficult to control unnecessary heat which may cause a crack of the ceramic.

As to the sand blast method, it is difficult to obtain an accurate depth and area of the removed portion because the sands of carbon silicate are too hard and also cut the nozzle itself. Therefore, the nozzle needs to be changed frequently otherwise the diameter of the cut area becomes large. Generally, according to the sand blast method, "try and check" (measuring filter characteristic during the trimming step) is necessary to obtain a fine tuned ceramic filter.

As to the micro rotary grinder method, because the diamond point is easily clogged with the powder of ceramic which is cut with the removed metallic layer, it is necessary to dress the diamond point frequently. Further, sometimes, the powder of diamond comes off the diamond point, and it is necessary to change the diamond point.

As a result of the aforementioned disadvantages, the above trimming methods are rather unsuitable for automating the tuning step.

OBJECTS AND SUMMARY OF THE INVENTION

An object of the present invention is to provide a new grinder system which does not have the above mentioned problems. Another other object of the present invention is to provide a grinder system which is suitable for automating the trimming steps. Another object of the invention is to provide a grinder system which can provide an accurate depth and width of the trimming area. A further object of the present invention is to provide appropriate steps to obtain preferable patterns of the metallic layer on the dielectric filter.

To accomplish the above and other objects, the present invention provides an ultrasonic grinder comprising an "XYZ stage" including three stage portions each having its movement controlled by respective control pulses, a microcomputer for controlling the movement of the respective stage portions by generating the respective control pulses, a vibrator means with a cutting blade mounted on one of the stage portions vibrating at an ultrasonic frequency and forcing the metallic layer on the ceramic filter which is mounted on another stage portion, and a sensor connected to the microcomputer which is mounted for detecting vibration of the ceramic filter.

Further, according to the present invention, the microcomputer narrows the distance between the vibrating cutting blade and the ceramic filter by moving at least one of the stage portions. When the cutting blade mates with the ceramic filter, the vibration of the cutting blade is immediately detected by the sensor and the microcomputer stops the movement of the stage portion in response to the detection. Then, the microcomputer detects a surface of the ceramic filter and can proceed with necessary trimming procedures according to a software driver controller. For example, the microcomputer can move the stage portion on which the ceramic filter is mounted in an approximately perpendicular direction to the cutting blade.

One of the essential points of the present invention is automatically to find the surface of the ceramic filter to be trimmed. After finding the surface at a standard level, the microcomputer controls the three dimensional movement of the XYZ stage to obtain a predetermined depth and area of the trimmed area.

Further, according to another aspect of the invention, a rectangular cutting blade is prepared having an edge of 90 to 110 degrees and the cutting blade is mounted on the vibrator to make an angle of 50 to 70 degrees between the metallic layer on the ceramic filter and the cutting blade. The tilted and vibrated cutting blade makes trimming efficient and reduces burrs at the trimmed area.

BRIEF DESCRIPTION OF THE DRAWINGS

These and other features and advantages of the invention may be more completely understood from the following detailed description of the preferred embodiments of the invention with reference to the accompanying drawings in which:

FIG. 8(*b*) is a graph showing the relation between forward speed of the cutting blade and cutting width;

FIG. 9(*b*) is a partial sectional view of the ceramic filter after the trimming according to the present invention.

DESCRIPTION OF THE PREFERRED EMBODIMENT

Figure 1:
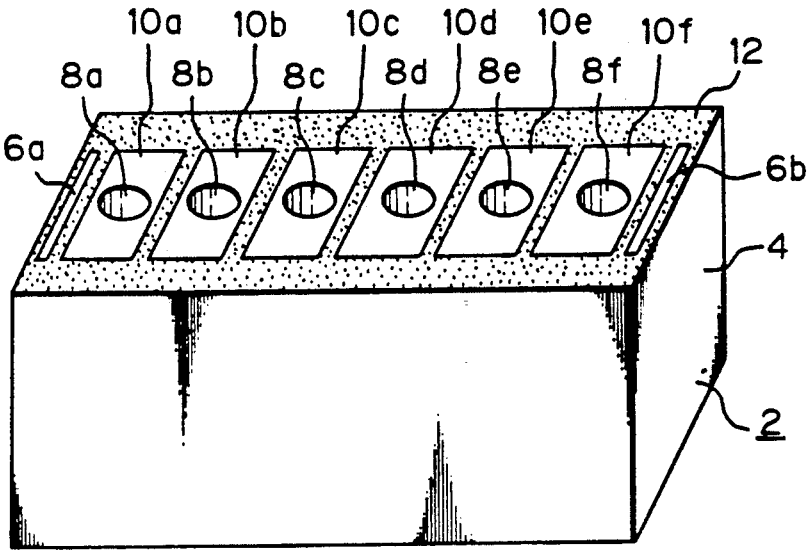
FIG. 1 is a perspective view which illustrates an example of a conventional ceramic filter.

As shown in FIG. 1, a conventional ceramic filter 2 comprises a rectangular ceramic (dielectric) body 12, an outer metallic layer 4 which surrounds side and bottom surfaces of the ceramic body 12, input and output metallic layers 6*a* and 6*b* which are provided on the upper surface of the ceramic body 12 as metallic layers, and a plurality of resonators 8*a*, 8*b*, 8*c*, 8*d*, 8*e*, and 8*f* which are provided in respective holes going through the upper surface and the bottom surface. Each of the resonators has a respective metallic layer 10*a*, 10*b*, 10*c*, 10*d*, 10*e*, and 10*f* which is to be trimmed on the upper surface of the dielectric body 12 to tune the resonance frequency of the filter itself. Hereinafter, the denotation 10 means a representative metallic layer among the metallic layers from 10*a* to 10*f* to be trimmed.

The present invention, of course, can be applied to other types of ceramic filters have which has at least one metallic layer to be trimmed.

Figure 2:
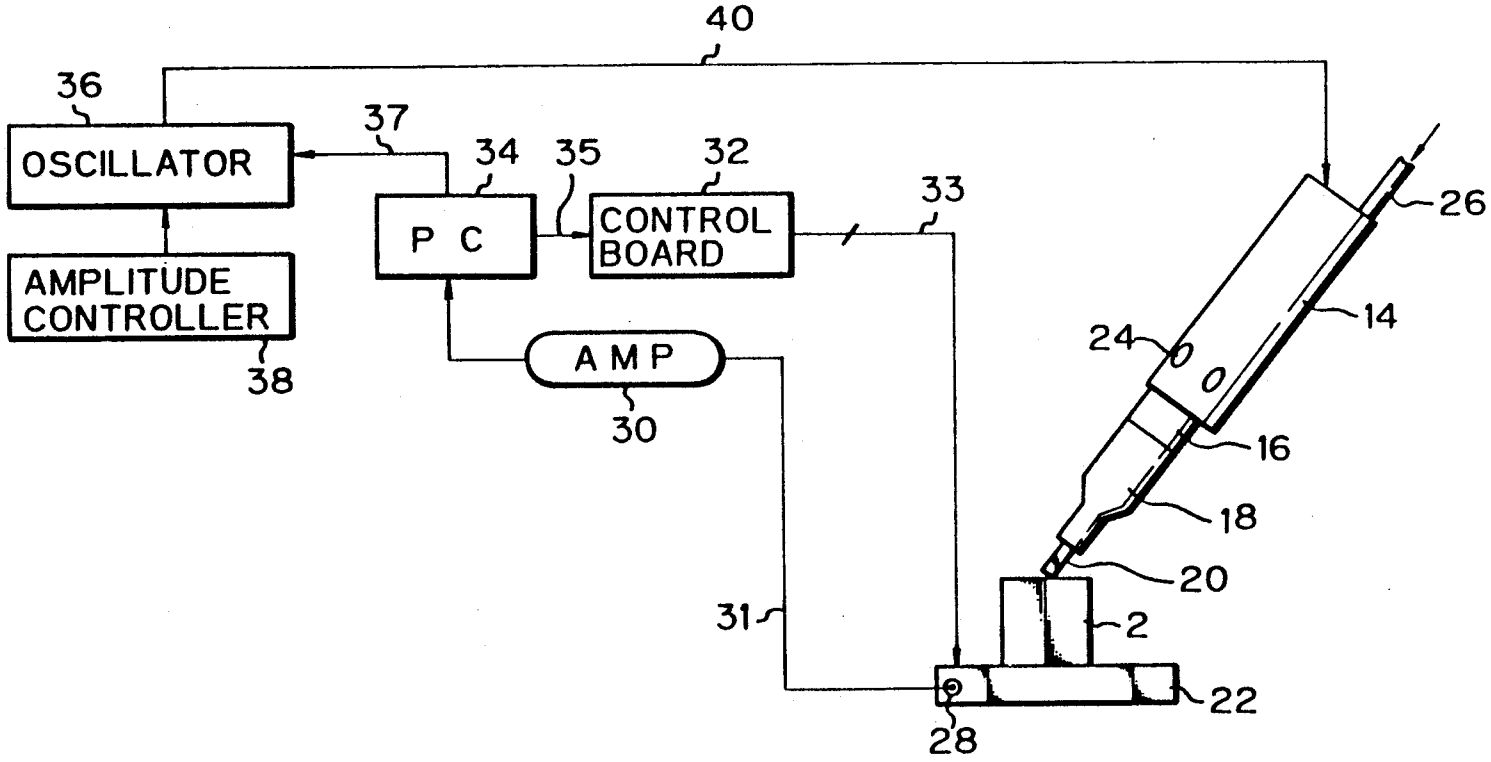
FIG. 2 illustrates a general block diagram of the ultrasonic grinder system of the present invention.

As shown in FIG. 2, an ultrasonic grinder system according to the present invention uses a vibrator 14 on which a cutting blade 20 is mounted via a corn 16 and a horn 18. Both corn 16 and horn 18 will transfer ultrasonic vibration to the mounted cutting blade 20. In this embodiment, we used a conventional vibrator model UV-30Z28-5B made by Ultrasonic Industry Co., LTD. in Japan. The vibrator 14 has an air duct 26 which inhales cooling air and ventilation holes 24 for ventilating warmed cooling air.

Figure 3:
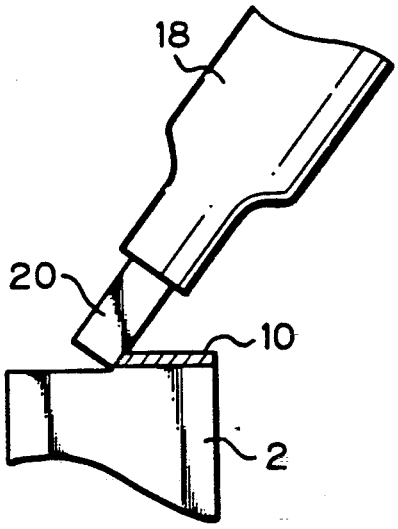
FIG. 3 is a side view in partial section which illustrates a partially enlarged view of the cutting blade and the ceramic filter for explaining the relation between them.

The cutting blade 20 could be made of diamond, WC-Co alloy, or hardened Titanium which can cut not only the metallic layer 10 but also the ceramic body 12. A detailed view of the cutting blade 20 is illustrated in FIG. 3. In this embodiment, the cutting blade 20 itself has a rectangular shape, with a cutting edge that is formed by adjacent surfaces meeting at approximately 90 degrees. This angle may be selected for durability of the blade and can range from 90 to 100 degrees. Further, the size of the cutting blade 20 also can be selected for the size of the metallic layer 10. In this embodiment, we used a conventional cutting blade model HTi03T (diameter = 3 mm) made by Mitsubishi Metal Co., LTD. in Japan. Generally, according to our experiments, a size of 0.3 to 1 mm thick and 2 mm wide was preferable for the current marketed ceramic filters. As shown in FIG. 2 and FIG. 3, the cutting blade 20 and the upper surface of the ceramic filter 2 should be contacted at an angle of 50 to 70 degrees. The lower angle of the vibrator (i.e. 50 degrees) makes a bigger cutting area and makes it rather difficult to conduct fine tuning. Further, the higher angle of the vibrator (i.e. 70 degrees) makes it rather easy to conduct the fine tuning but also makes it rather hard to dig the ceramic body because of rectangular cutting blade. We selected a 65 degree contact angle for the preferred embodiment.

As shown in FIG. 2, the vibrator 14 is controlled by an oscillator 36 via a control line 40. The oscillator 36 generates an ultrasonic frequency signal, which in this embodiment, is a 28 KHz frequency signal and the vibrator 14 vibrates at the 28 KHz frequency. In this embodiment, we used a conventional oscillator model UE-200Z28S made by Ultrasonic Industry Co., LTD. in Japan.

Further, the voltage amplitude of the frequency signal is controlled by an amplitude controller 38. The amplitude of the vibration at the vibrator 14 is proportional to the amplitude of the frequency signal on the control line 40. As a result, the depth of the trimmed area can be determined by the amplitude controller 38. In this embodiment, we used a conventional amplitude controller model UET-200 made by Ultrasonic Industry Co., LTD. in Japan.

Figure 4:
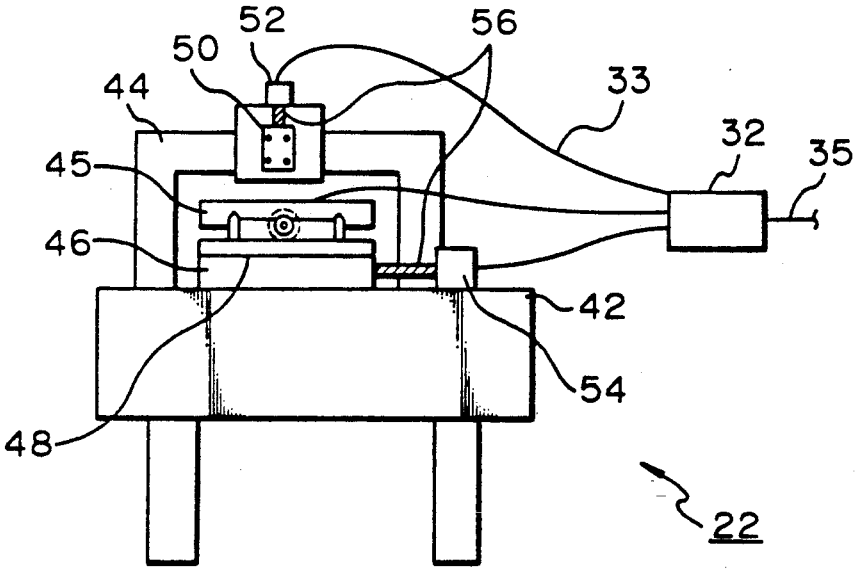
FIG. 4 is a schematic side view of an XYZ stage of the ultrasonic grinder system of the present invention.
Figure 5:
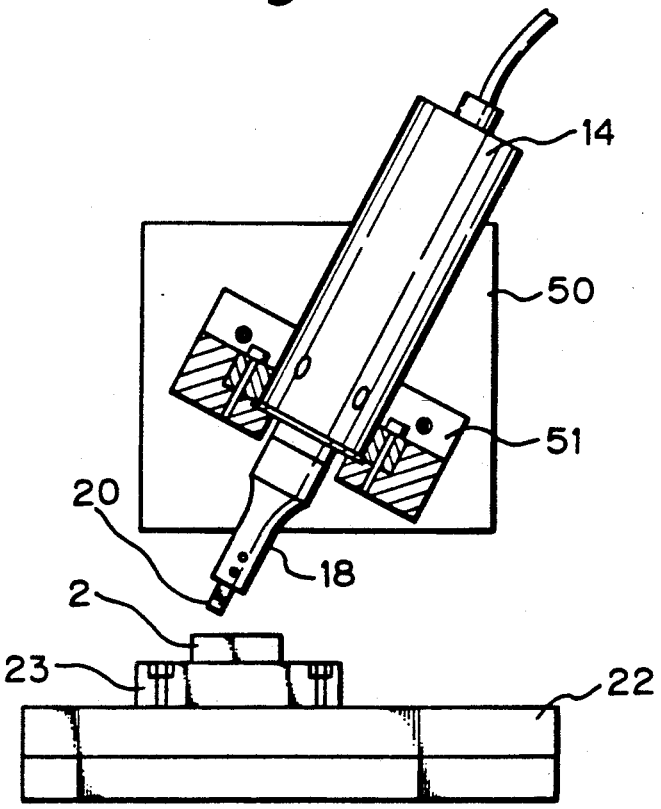
FIG. 5 is a side view in partial section which illustrates a partially enlarged portion of a Z stage of the XYZ stage of the present invention for showing how a vibrator is mounted on the Z stage.

Referring to FIG. 4 and FIG. 5, there is shown on XYZ stage 22 where the ceramic filter 2 is mounted on an X stage 45 using a vice 23. The XYZ stage 22 mainly comprises a rectangular stone base 42, a beam 448 the X stage 45, a Y stage 46, and a Z stage 50. The three stages 45, 46 and 47 are together known as the "XYZ stage." The movement of the three stages 45, 46 and 50 thereof is controllable by respective stepping motors 48, 54, and 52 via respective screws 56. Those stepping motors are also controlled by the control board 32 (See FIG. 2.) via motor control lines 33. In this embodiment, we used a conventional XY stage model, namely, model XYCC1020-801-001 made by NSK Inc. in Japan, and, we added one added one controllable Z stage 50 and a stepping motor therefor with the beam 44. Further, we modified an attached control board model B-990-1-22 made by NSK Inc. for the control board 32 to control the movement of added Z stage 50. Further, as stated above, the vibrator 14 is mounted on the Z stage 50 by a flange mounter 51 at an angle of 50 to 70 degrees relative to the top surface of ceramic filter 2.

As shown in FIG. 2, the control board 32 is also controlled by a micro computer 34 via an RS-232C interface 35. In this embodiment, we used a personal computer if-800 model 50 made by OKI ELECTRIC INDUSTRY CO., LTD. in Japan. Further, the micro computer 34 has another interface port and is monitoring vibration of the XYZ stage 22 using a vibration sensor 28 via sensing line 31 and an amplifier 30. In this embodiment, we used an acceleration sensor model 708 made by TEAC Inc. in Japan as the vibration sensor 28 and an amplifier model SA25 made by TEAC Inc. for the amplifier 30. The sensor 28 changes vibration to a voltage signal which represents a magnitude of the vibration. The amplifier 30 amplifies the voltage signal and the microcomputer 32 can receive the amplified voltage signal and detects the vibration. Further, the microcomputer 34 can control the oscillator 36 via a switching line 37 in an ON/OFF manner.

Figure 6:
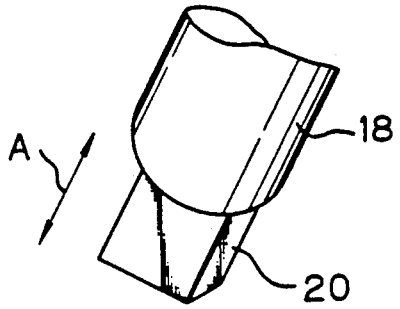
FIG. 6 is a perspective view which illustrates a partially enlarged portion of a cutting blade of the present invention.

In a frequency tuning method using the described XYZ stage and vibrator, a metallic layer 10 is trimmed by the vibrated cutting blade 20 as follows. As shown in FIG. 6, the cutting blade 20 is vibrating in an axial direction which is illustrated as a bidirectional arrow A. In this embodiment, the vibrating frequency is at approximately 28 KHz as set by the oscillator 36 and the amplitude of the vibration, as set by the amplitude controller 38, is at approximately 20 μm. Assume that the ceramic filter 2 has already been fixed under the cutting blade 20 of the vibrator 14 so that the cutting blade 20 faces the metallic layer 10 to be trimmed.

At first, the microcomputer 34 controls the Z stage 50 to slowly lower the vibrator 14 to the ceramic filter 2. In this embodiment, each of the stepping motors 48, 52, and 54, can go forward or backward at 4 μm per pulse sent by the control board 32. According to experiment, the cutting blade 20 goes down at approximately 8 mm/s.

The microcomputer 34 monitors for the presence of the vibration using the sensor 28 after sending each stepping pulse to the stepping motor 52. If the microcomputer 34 does not detect the vibration, then the microcomputer 34 sends a single pulse to the stepping motor 52 via the control board 32. When the cutting blade 20 touches the upper surface of the ceramic filter 2, the vibration of the cutting blade 20 is immediately transferred to the XYZ stage 22 and the sensor 28 can detect the vibration. The microcomputer 34 then knows that the cutting blade 20 has touched the ceramic filter 2. At this point, the cutting blade 20 has already dug into the ceramic body 12 at most 4 μm. This is a standard (i.e. reference) level for the trimming.

Figure 7:
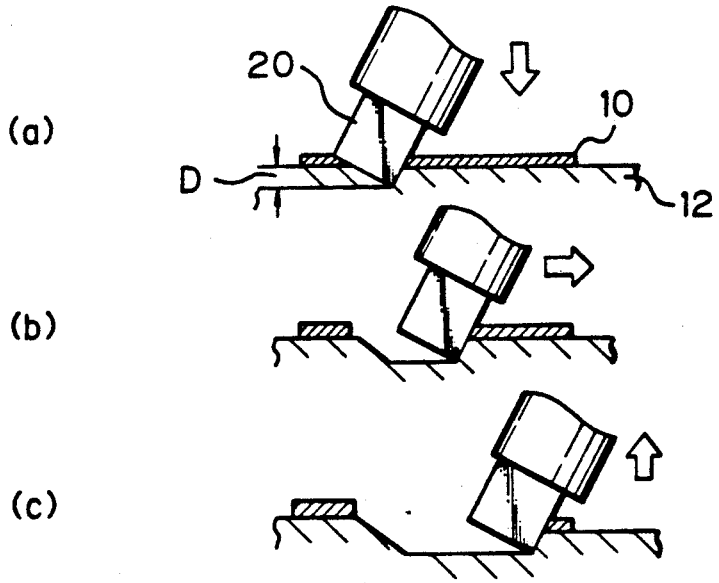
FIG. 7 is a series of side views, in partial section, of a cutting blade and ceramic filter for illustrating the trimming steps according to the present invention.

According to software control, then the microcomputer 34 sends nine pulses to the stepping motor 52 to move the Z stage 50 to lodge the cutting blade 20 in the ceramic body 12 approximately at 40 μm. As shown in FIG. 7, in step (a), the cutting blade 20 lodges in the ceramic body 12. The depth D in the FIG. 7(*a*) is approximately 40 μm. According to the present invention, because the sensor 28 always detects the surface of the ceramic filter 2, the depth of the trimming area can be determined independently of the actual height of the ceramic filter. In other words, the depth D is always approximately 40 μm from the top surface of any ceramic filter. This is a very important feature for automating the tuning method.

Figure 8A:
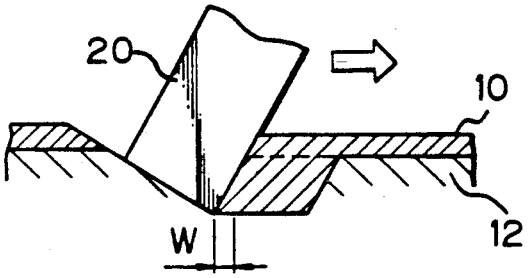
FIG. 8(*a*) is a partial sectional view of the ceramic filter for explaining the relation between the forward speed of the cutting blade and cutting width.
Figure 8B:
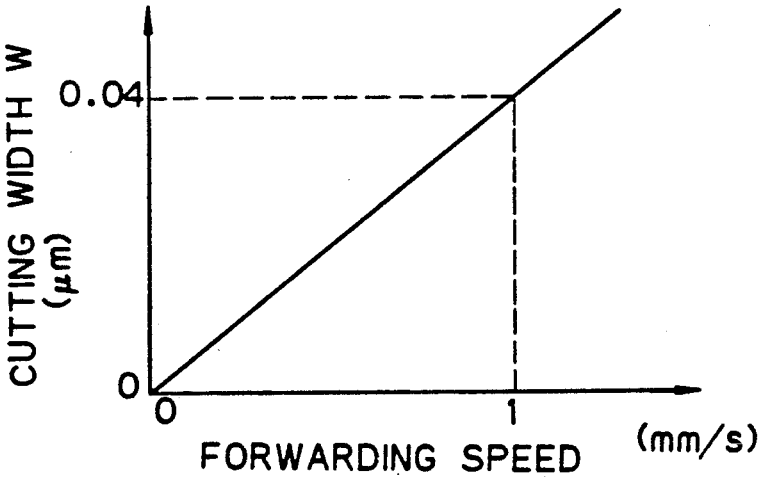

Next, in step (b), after digging the 40 μm depth, the microcomputer 34 stops the Z stage 50 and controls the X stage 45 or Y stage 46 to conduct necessary fine tuning. In this step, the cutting blade 20 is moved forward at the speed of approximately 1 mm/s in the X or Y direction. As shown in FIG. 8(*a*), because the cutting blade 20 vibrates 28000 times per second, the minimum cutting width W per stroke is 1000 μm (1 mm)/28000=approximately, 0.036 μm. Of course, as shown in FIG. 8(*b*), the cutting width W can be selected by selecting the forwarding speed of the cutting blade 20. Further, the cutting direction can be defined by the software in the microcomputer 34 according to necessity.

Generally, a smaller cutting width results in a more finely tuned ceramic filter. According to experiment, the minimum tuned frequency is approximately 0.1 MHz. This figure means that the system according to the present invention can tune to 1/8000 frequency of the usual 800 MHz band ceramic filter for Cellular Communication System.

Further, according to the present invention, generation of unnecessary heat is rather low compared with the above mentioned rotary grinder method or the laser trimming method. According to experiment, the maximum temperature of the ceramic filter which was being trimmed was approximately 70° C. degrees. Therefore, the system of the present invention does not need any cooling oil or cooling water. This is a very important feature for automating the trimming method.

Still further, according to the present invention, it is not necessary to dress the cutting blade 20, because the cutting blade 20 is vibrating at ultrasonic frequency and cut particles are scattered automatically. This means that the cutting blade 20 has a self-cleaning characteristics.

If a predetermined area to be trimmed is finished, as shown in FIG. 7(*c*), the microcomputer 34 controls the Z stage 50 to lift up the cutting blade 20 from the ceramic body 12.

Figure 9:
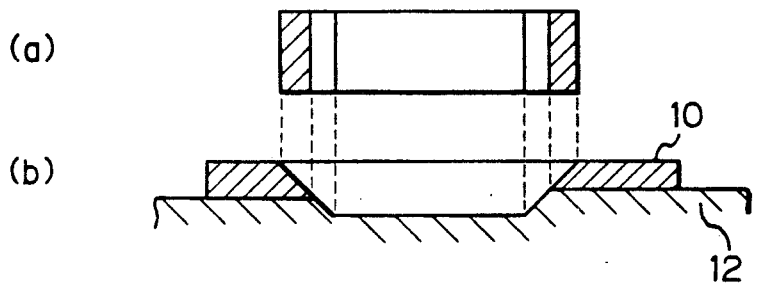
FIG. 9(*a*) is an upper view of the ceramic filter after the trimming according to the present invention.
Figure 10:
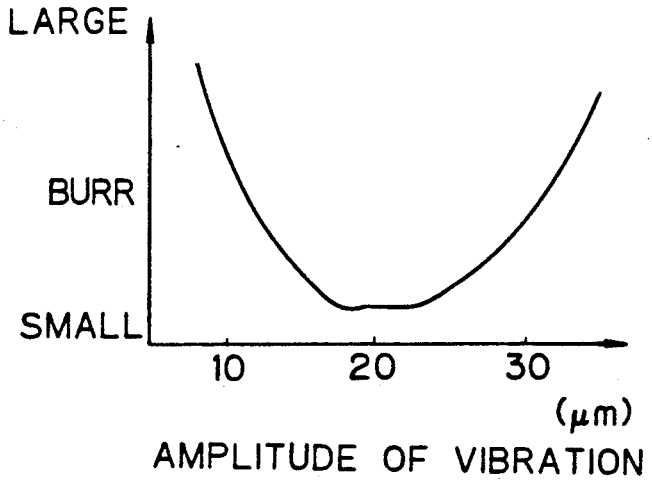
FIG. 10 is a graph showing the relation between amplitude of the vibration and frequency of burns caused by the trimming.

As shown in FIG. 9, according to the present invention, there can be obtained a constant depth and sharpened edge of the trimmed metallic layer 10. Further, according to experiment, the frequency of burrs of the trimmed metallic layer 10 was minimized at 20 μm amplitude of vibration. Generally, such burrs cause flowing capacity or harmful dust if dropped, and should be eliminated for fine tuning of the ceramic filters.

As described above, our ultrasonic grinder system can locate the surface of the ceramic filter at a standard level for the trimming and provide an accurate depth of the trimmed area. Further, it is possible to define the pattern of the trimmed area by way of software control. Still further, because of the lower heat generation, and the self trimming depth control, our ultrasonic grinder system is suitable for automating the tuning of ceramic filters.

What is claimed is:

1. An ultrasonic grinder system for trimming a metallic layer on a ceramic filter comprising:

(a) a stage means having at least two stage portions each of whose movement is controlled by respective control pulses, the ceramic filter being mounted on a first stage portion of said stage means;

(b) a vibrator means mounted on a second stage portion vibrating at ultrasonic frequency;

(c) a cutting blade mounted on said vibrator means and facing the metallic layer on the ceramic filter for trimming;

(d) sensor means mounted on the first stage portion for detecting vibration of the first stage portion, said sensor means generating a sensing signal in response to the detection of vibration of the first stage portion; and (e) a controller means connected to both of the stage portions and said sensor means for sending the control pulses and controlling the movement of at least one of the stage portions to close the distance between the cutting blade and the metallic layer on the ceramic filter to mate each other, said controller means stopping the movement in response to the sensing signal from said sensor means;

whereby, said controller means can detect the surface of the ceramic filter which is a standard level for the trimming.

2. An ultrasonic grinder system for trimming a metallic layer on a ceramic filter according to claim 1 wherein, said cutting blade has a rectangular shape and has at least one cutting edge formed by adjacent surfaces meeting at an angle of approximately 90 to 110 degrees.

3. An ultrasonic grinder system for trimming a metallic layer on a ceramic filter according to claim 1 wherein, the frequency of the vibration of the cutting blade is approximately 28 KHz.

4. An ultrasonic grinder system for trimming a metallic layer on a ceramic filter according to claim 1 wherein, said vibrator is tilted at 50 to 70 degrees to the metallic layer on the ceramic filter.

5. An ultrasonic grinder system for trimming a metallic layer on a ceramic filter according to claim 1, wherein said cutting blade vibrates with an amplitude of approximately 20 micrometers.

6. A method for trimming a metallic layer on a ceramic filter, comprising steps of:

(a) mounting a rectangular cutting blade which is vibrating at ultrasonic frequency so that the cutting blade faces the metallic layer to be trimmed, said cutting blade and the metallic layer having an angle of 50 to 70 degrees relative to one another;

(b) moving the vibrating cutting blade and ceramic filter relative to one another until the cutting blade contacts and penetrates into the ceramic filter at a predetermined depth; and (c) moving the ceramic filter in an approximately perpendicular direction to a direction normal to the metallic layer to obtain a predetermined trimmed area of the metallic layer at the predetermined depth.

7. A method for trimming a metallic layer on a ceramic filter according to claim 6, wherein said cutting blade has a rectangular shape and has at least one cutting edge formed by adjacent surfaces meeting at an angle of approximately 90 to 110 degrees.

8. A method for trimming a metallic layer on a ceramic filter according to claim 6, wherein the frequency of the vibration of the cutting blade is approximately 28 KHz.

9. A method for trimming a metallic layer on a ceramic filter according to claim 6, including the step of vibrating the cutting blade so that it vibrates with an amplitude of approximately 20 micrometers.

10. An ultrasonic grinder system for trimming a metallic layer on a ceramic filter, comprising:

first and second stages spaced apart from each other and mounted for movement relative to each other, with the ceramic filter being mountable on one of said stages;

moving means for moving said first and second stages relative to one another in response to control pulses;

a vibrator mounted on the other of said two stages, said vibrator having an ultrasonic vibrating frequency;

a cutting blade attached to said vibrator for facing the metallic layer on the ceramic filter to be trimmed;

a sensor mounted on said one stage for detecting vibration of said one stage and generating a signal in response to the detection of vibration of said one stage; and controller means connected to said moving means and to said sensor for sending control pulses to said moving means for causing relative movement between said stages to close a distance between said cutting blade and the metallic layer on the ceramic filter and for stopping the relative movement when said controller receives a signal from said sensor, the signal indicating that said cutting blade has touched the metallic layer, thereby transmitting vibrations to said one stage by way of the ceramic filter.

11. A system as defined in claim 10, wherein said cutting blade has a rectangular shape and has at least one cutting edge formed by adjacent surfaces meeting at an angle of approximately 90 to 110 degrees.

12. A system as defined in claim 10, wherein said vibrator has a vibrating frequency for vibrating said cutting blade at approximately 28 KHz.

13. A system as defined in claim 10, wherein said vibrator is tilted at an angle of 50 to 70 degrees relative to the metallic layer on the ceramic filter.

14. A system as defined in claim 10, wherein said cutting blade vibrates with an amplitude of approximately 20 micrometers.

15. An method for trimming a metallic layer on a ceramic filter employing an ultrasonic vibrator having a cutting blade and driving the cutting blade to vibrate at an ultrasonic frequency, comprising:

mounting the ceramic filter on one stage;

mounting the ultrasonic vibrator on another stage with the cutting blade facing the metallic layer and separated by a distance from the metallic layer;

moving the stages toward one another to close the distance between the cutting blade and the metallic layer;

detecting vibrations of the one stage, signifying that the vibrating cutting blade has contacted the metallic layer; and stopping the movement of the stages toward one another in response to said detecting step.

16. A method as defined in claim 15, including providing the cutting blade with a rectangular shape and at least one cutting edge formed by adjacent surfaces meeting at an angle of approximately 90 to 110 degrees.

17. A method as defined in claim 15, including vibrating the cutting blade at approximately 28 KHz.

18. A method as defined in claim 15, wherein said step of mounting the vibrator includes mounting the vibrator so that it is tilted at an angle of 50 to 70 degrees relative to the metallic layer on the ceramic filter.

19. A method as defined in claim 15, including the step of vibrating the cutting blade so that it vibrates with an amplitude of 20 micrometers.

* * * * *